US009231308B2

(12) United States Patent
Kuo et al.

(10) Patent No.: US 9,231,308 B2
(45) Date of Patent: Jan. 5, 2016

(54) FEEDING APPARATUS AND LOW NOISE BLOCK DOWN-CONVERTER

(71) Applicant: Wistron NeWeb Corporation, Hsinchu (TW)

(72) Inventors: Shun-Chung Kuo, Hsinchu (TW); Chao-Kai Chan, Hsinchu (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 31 days.

(21) Appl. No.: 14/298,984

(22) Filed: Jun. 9, 2014

(65) Prior Publication Data

US 2015/0091771 A1 Apr. 2, 2015

(30) Foreign Application Priority Data

Sep. 27, 2013 (TW) ..... 102135083 A

(51) Int. Cl.

| | |
|---|---|
| ***H01Q 13/00*** | (2006.01) |
| ***H01Q 13/02*** | (2006.01) |
| ***H01P 1/161*** | (2006.01) |
| ***H01Q 15/24*** | (2006.01) |

(52) U.S. Cl.

CPC ..... *H01Q 13/02* (2013.01); *H01P 1/161* (2013.01); *H01Q 15/24* (2013.01)

(58) Field of Classification Search

USPC ..... 343/772, 786; 333/33

See application file for complete search history.

(56) References Cited

U.S. PATENT DOCUMENTS

| | | | | |
|---|---|---|---|---|
| 8,254,851 | B2 * | 8/2012 | Laidig | H01Q 1/247 333/135 |
| 2002/0144392 | A1 * | 10/2002 | John | H01P 1/213 29/600 |
| 2011/0133863 | A1 * | 6/2011 | Lange | H01P 1/173 333/21 A |

* cited by examiner

*Primary Examiner* — Tan Ho

(74) *Attorney, Agent, or Firm* — Winston Hsu; Scott Margo

(57) ABSTRACT

A feeding apparatus includes a substrate, an annular grounded metal sheet having a first opening and a second opening, a rectangular grounded metal sheet extending from the annular grounded metal sheet toward an interior according to a configuration of a septum polarizer of a waveguide, a first parasitic grounded metal sheet extending from a side of the rectangular grounded metal sheet along a first direction, a second parasitic grounded metal sheet extending from another side of the rectangular grounded metal sheet along a second direction, a first feeding metal sheet extending from the first opening toward the interior and including a first portion, a second portion and a third portion and a second feeding metal sheet extending from the second opening toward the interior and including a fourth portion, a fifth portion and a sixth portion.

20 Claims, 19 Drawing Sheets

FEEDING APPARATUS AND LOW NOISE BLOCK DOWN-CONVERTER

BACKGROUND OF THE INVENTION

1. Field of the Invention

The present invention relates to a feeding apparatus and a low noise block down-converter for a waveguide, and more particularly, to a feeding apparatus and a low noise block down-converter, which can simultaneously modify impedance matching at high frequencies and low frequencies and reduce return loss.

2. Description of the Prior Art

Satellite communication has the advantage of wide communication coverage and being free from interference from ground environment, and is widely used for military communication, exploration and business communication services such as satellite navigation, satellite voice broadcast and satellite television broadcast. A conventional satellite communication receiving device consists of a dish reflector and a low noise block down-converter. The low noise block down-converter is disposed at the focus of the dish reflector. After the low noise block down-converter receives radio signals reflected from dish reflector, the low noise block down-converter converts the radio signals down to middle band, and then transmits the radio signals to a back-end radio frequency processing unit for signal processing, thereby providing satellite television programs to users.

Please refer to FIG. 1A that is a schematic diagram illustrating a conventional low noise block down-converter 10 for satellite communication. The low noise block down-converter 10 can be disposed at the focus of a dish reflector to collect radio signals reflected by the dish reflector. As shown in FIG. 1A, the low noise block down-converter 10 consists of a feedhorn 12, a waveguide 14, a septum polarizer 16 and a feeding apparatus 100. The septum polarizer 16 is fixed in the waveguide 14 with a cylindrical shape, and divides the interior of the waveguide 14 in half. FIG. 1B is a schematic diagram illustrating a top view of a front surface of the conventional feeding apparatus 100. The feeding apparatus 100 is utilized to transmit the radio signals received by the feedhorn 12 to a back-end radio frequency processing unit, and consists of a substrate 110, an annular grounded metal sheet 120, a rectangular grounded metal sheet 130, feeding metal sheets 140*a*, 140*b* and signal wires 150*a*, 150*b*.

Conventionally, in order to adjust operating frequency range of the low noise block down-converter 10, lengths of the feeding metal sheets 140*a*, 140*b* are modified to control impedance of the feeding apparatus 100 so that impedance matching may be achieved with sufficient bandwidth. In practice, however, failures frequently occur—there exists a tradeoff among frequencies. Specifically, please refer to FIG. 1C, which is a schematic diagram illustrating return loss of the feeding apparatus 100 in Ku band (10.7 GHz-12.75 GHz). As shown in FIG. 1C, the return loss of the feeding apparatus 100 is low, merely in a range of 11.00 GHz to 12.00 GHz, while the return loss of the feeding apparatus 100 from 10.7 GHz to 11.00 GHz and from 12.00 GHz to 12.75 GHz is quite high and grows rapidly. Therefore, the feeding apparatus 100 cannot optimize return loss at high frequencies and low frequencies at the same time. Along with the growing needs for satellite television, the number of frequency bands covered by direct broadcast satellites is increasing; as a result, there is an urgent need for improvement in the field.

SUMMARY OF THE INVENTION

It is therefore one of the objectives of the present invention to provide a feeding apparatus and a low noise block down-converter to effectively modify impedance matching at high frequencies and low frequencies and reduce return loss.

An embodiment of the invention provides a feeding apparatus adapted to a waveguide. The feeding apparatus comprises a substrate; an annular grounded metal sheet, disposed on the substrate, substantially in a shape of an annularity, and having a first opening and a second opening; a rectangular grounded metal sheet, disposed on the substrate, extending from the annular grounded metal sheet across an interior of the annularity and corresponding to a configuration of a polarizer of the waveguide; a first parasitic grounded metal sheet, extending from a side of the rectangular grounded metal sheet along a first direction; a second parasitic grounded metal sheet, extending from another side of the rectangular grounded metal sheet along a second direction, wherein the second direction is substantially opposite to the first direction; a first feeding metal sheet, extending from the first opening toward the interior of the annularity and comprising a first portion, a second portion and a third portion, wherein a width of the first portion is different from a width of the second portion, and the width of the second portion is different from a width of the third portion; and a second feeding metal sheet, extending from the second opening toward the interior of the annularity and comprising a fourth portion, a fifth portion and a sixth portion, wherein a width of the fourth portion is different from a width of the fifth portion, and the width of the fifth portion is different from a width of the sixth portion.

Another embodiment of the invention provides a low noise block down-converter adapted to a communication receiving device. The low noise block down-converter comprises a feedhorn, a waveguide, a polarizer, and a feeding apparatus. The feeding apparatus comprises a substrate; an annular grounded metal sheet, disposed on the substrate, substantially in a shape of an annularity, and having a first opening and a second opening; a rectangular grounded metal sheet, disposed on the substrate, extending from the annular grounded metal sheet across an interior of the annularity and corresponding to a configuration of a polarizer of the waveguide; a first parasitic grounded metal sheet, extending from a side of the rectangular grounded metal sheet along a first direction; a second parasitic grounded metal sheet, extending from another side of the rectangular grounded metal sheet along a second direction, wherein the second direction is substantially opposite to the first direction; a first feeding metal sheet, extending from the first opening toward the interior of the annularity and comprising a first portion, a second portion and a third portion, wherein a width of the first portion is different from a width of the second portion, and the width of the second portion is different from a width of the third portion; and a second feeding metal sheet, extending from the second opening toward the interior of the annularity and comprising a fourth portion, a fifth portion and a sixth portion, wherein a width of the fourth portion is different from a width of the fifth portion, and the width of the fifth portion is different from a width of the sixth portion.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
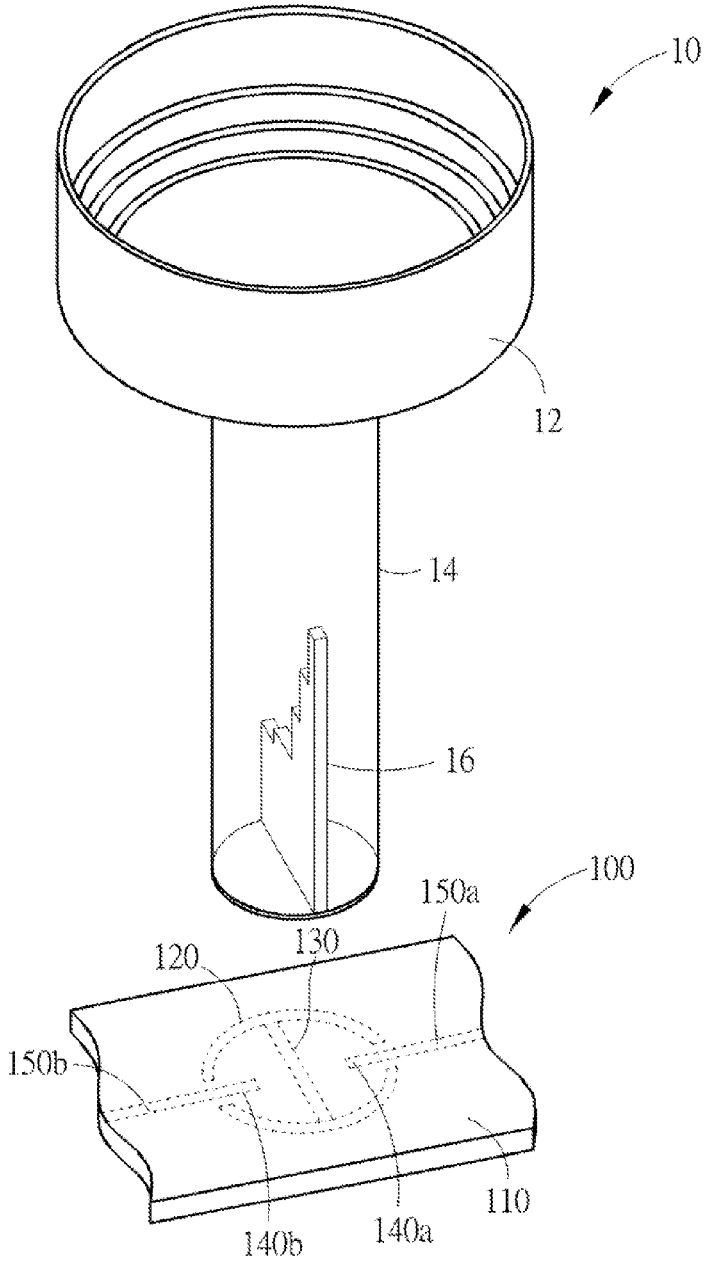
FIG. 1A PRIOR ART
FIG. 1A is a schematic diagram illustrating a conventional low noise block down-converter for satellite communication.
Figure 1B:
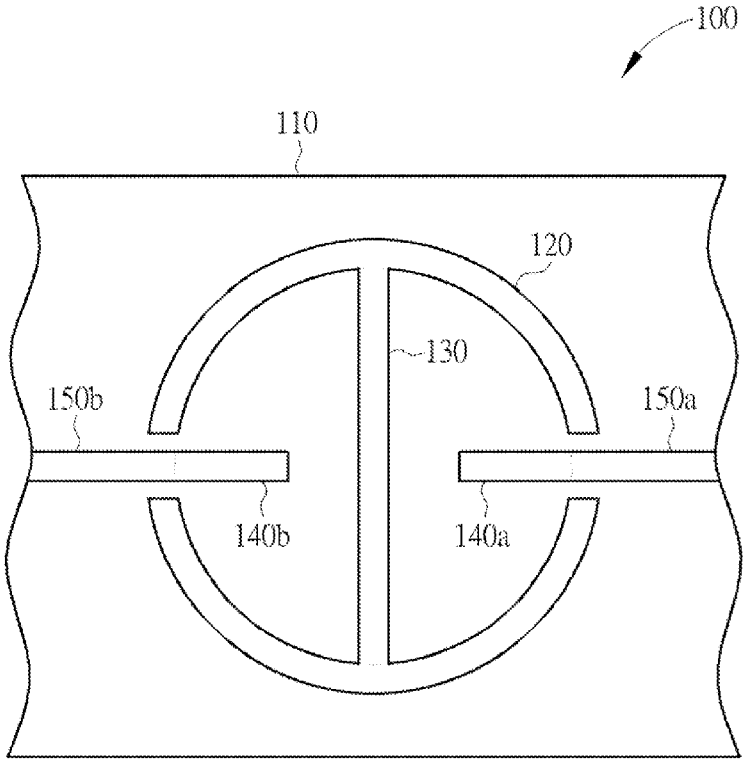
FIG. 1B PRIOR ART
FIG. 1B is a schematic diagram illustrating a top view of a front surface of the conventional feeding apparatus in FIG. 1A.
Figure 1C:
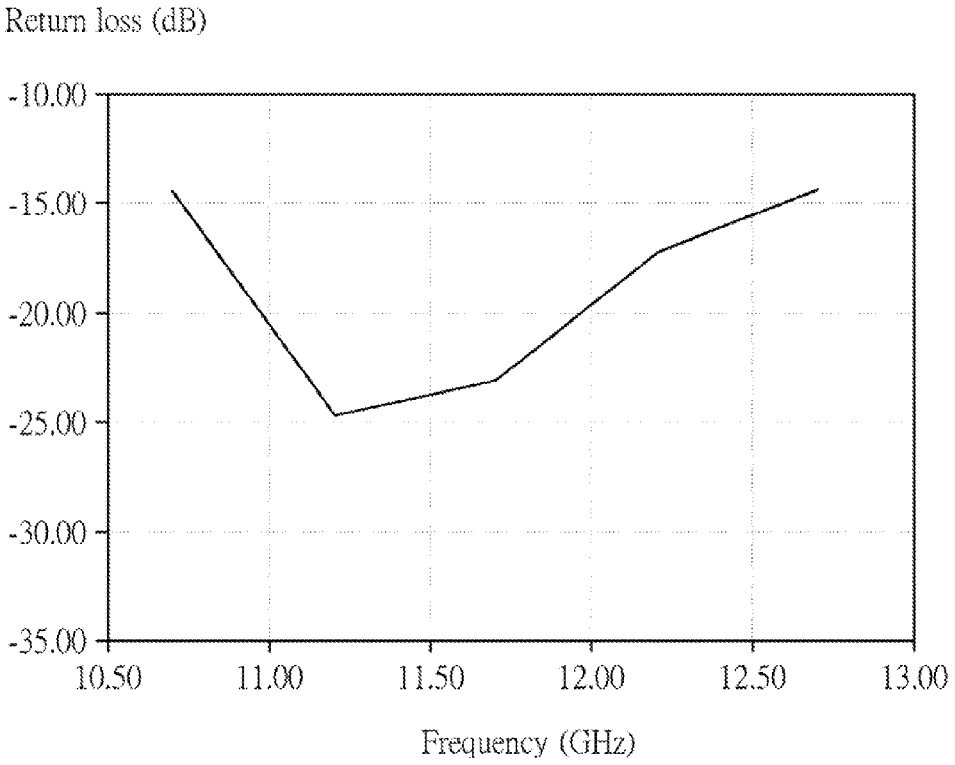
FIG. 1C PRIOR ART
FIG. 1C is a schematic diagram illustrating return loss of the feeding apparatus in FIG. 1A in Ku band.
Figure 2:
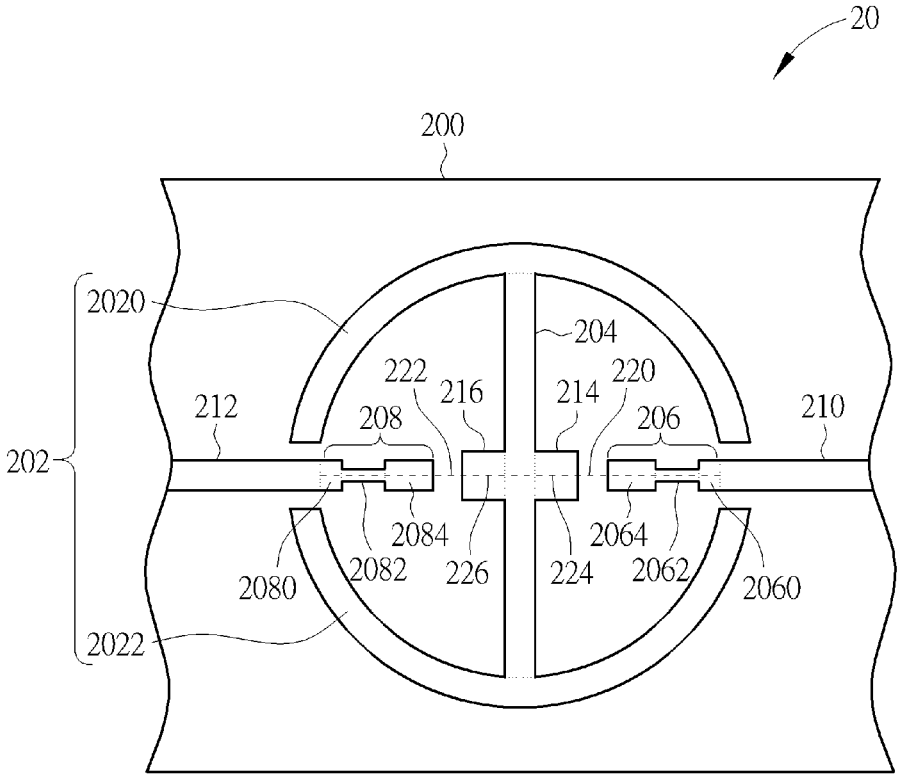
FIG. 2 is a schematic diagram illustrating a top view of a front surface of a feeding apparatus according to an embodiment of the present invention.

Please refer to FIG. 2. FIG. 2 is a schematic diagram illustrating a top view of a front surface of a feeding apparatus 20 according to an embodiment of the present invention. The feeding apparatus 20 may replace the feeding apparatus 100 in FIGS. 1A and 1B and be implemented in the low noise block down-converter 10 to transmit radio frequency signals received by the feedhorn 12 to the back-end radio frequency processing unit. The feeding apparatus 20 comprises a substrate 200, an annular grounded metal sheet 202, a rectangular grounded metal sheet 204, feeding metal sheets 206, 208, signal wires 210, 212 and parasitic grounded metal sheets 214, 216. The annular grounded metal sheet 202, the rectangular grounded metal sheet 204, the feeding metal sheets 206, 208, the signal wires 210, 212 and the parasitic grounded metal sheets 214, 216 are disposed on the substrate 200. The annular grounded metal sheet 202 is substantially in a shape of an annularity with two openings that break an enclosed circle in half, and therefore the annular grounded metal sheet 202 is divided into two separate portions 2020, 2022. The rectangular grounded metal sheet 204 is disposed inside the annular grounded metal sheet and connects the portions 2020 and 2022 of the annular grounded metal sheet 202; the portions 2020, 2022 are respectively symmetric with respect to the rectangular grounded metal sheet 204. The size and shape of the annular grounded metal sheet 202 and the rectangular grounded metal sheet 204 are respectively designed according to the size and shape of the waveguide 14 and the septum polarizer 16, so that they match with each other. Moreover, the rectangular grounded metal sheet 204 extends from the annular grounded metal sheet 202 across the interior of the annularity in a way corresponding to a configuration of the septum polarizer 16 of the waveguide 14. Therefore, by lining up the annular grounded metal sheet 202 with the waveguide 14 and by lining up the rectangular grounded metal sheet 204 with the septum polarizer 16, the waveguide 14, the septum polarizer 16 and the feeding apparatus 20 are put together to assemble the low noise block down-converter 10 as shown in FIG. 1. The parasitic grounded metal sheets 214, 216 of the feeding apparatus 20 are extended outward from each side of the rectangular grounded metal sheet 204 oppositely, and the parasitic grounded metal sheets 214 and 216 are respectively symmetric with respect to the rectangular grounded metal sheet 204. In addition, the feeding metal sheets 206 and 208 are respectively symmetric with respect to the rectangular grounded metal sheet 204, and extend from the two openings of the annular grounded metal sheet 202 toward the interior of the annularity. The signal wires 210 and 212 are respectively connected to the feeding metal sheets 206 and 208 through the two openings of the annular grounded metal sheet 202, and extend out (of the annularity) from the feeding metal sheets 206 and 208. The signal wires 210, 212 and the feeding metal sheets 206, 208 do not come into contact with the annular grounded metal sheet 202, and extending centerlines 220, 222 of the feeding metal sheets 206, 208 are respectively perpendicular to the rectangular grounded metal sheet 204.

With the parasitic grounded metal sheets 214, 216 and the feeding metal sheets 206, 208, the feeding apparatus 20 can simultaneously affect impedance and return loss at high frequencies and low frequencies.

Basically, the parasitic grounded metal sheets 214, 216 of the feeding apparatus 20 are extended outward from each side of the rectangular grounded metal sheet 204 oppositely, and a extending centerline 224 of the parasitic grounded metal sheet 214 and a extending centerline 226 of the parasitic grounded metal sheet 216 are respectively extended to the center of the rectangular grounded metal sheet 204; therefore, the parasitic grounded metal sheets 214, 216 are vertically aligned to a center of the rectangular grounded metal sheets 204. In addition, in this embodiment, the extending centerlines 220, 222, 224, 226 overlap as shown in FIG. 2, because the feeding metal sheets 206, 208 and the parasitic grounded metal sheets 214, 216 may be all vertically aligned to the center of the rectangular grounded metal sheet 204. However, in other embodiments, the extending centerlines 220, 222, 224, 226 may be shifted to form different lines, and the parasitic grounded metal sheets 214 and 216, for example, may be disposed close to one end of the rectangular grounded metal sheet 204 in such a situation. The parasitic grounded metal sheets 214 and 216 can ensure impedance matching at low frequencies, and have the impedance of the feeding apparatus 20 in operating frequency range to match better toward the low frequency end, thereby improving return loss at low frequencies.

On the other hand, because the feeding metal sheets 206 and 208 are symmetric, and because the widths of the feeding metal sheets 206 and 208 may vary respectively, the feeding metal sheet 206 (or, the feeding metal sheet 208) may include several segments. In particular, the feeding metal sheet 206 comprises portions 2060, 2062, 2064. The portion 2060 is electrically connected to the signal wire 210; the portion 2062 and the portion 2064 extend toward the interior of the annularity of the annular grounded metal sheet 202 in sequence. The width of the portion 2060 may be substantially about the same size as that of the signal wire 210, while the width of the portion 2062 is preferably less than that of the portion 2060 and that of the portion 2064. Moreover, the structure of the feeding metal sheet 208 is identical and symmetrical to that of the feeding metal sheet 206. The feeding metal sheet 208 comprises portions 2080, 2082, 2084. The portion 2080 is electrically connected to the signal wire 212; the portion 2082 and the portion 2084 extend toward the interior of the annularity of the annular grounded metal sheet 202 in sequence. The width of the portion 2080 may be substantially about the same size as that of the signal wire 212, while the width of the portion 2082 is preferably less than that of the portion 2080 and that of the portion 2084. Moreover, the width of the portion 2060 may be either equal to or distinct from that of the portion 2064; the width of the portion 2080 may be either equal to or distinct from that of the portion 2084. By modifying the widths of the feeding metal sheet 206, 208, the impedance can thus be changed, such that the impedance of the feeding apparatus 20 in operating frequency range tends to match better toward the high frequency end, thereby improving return loss at high frequencies.

Figure 3A:
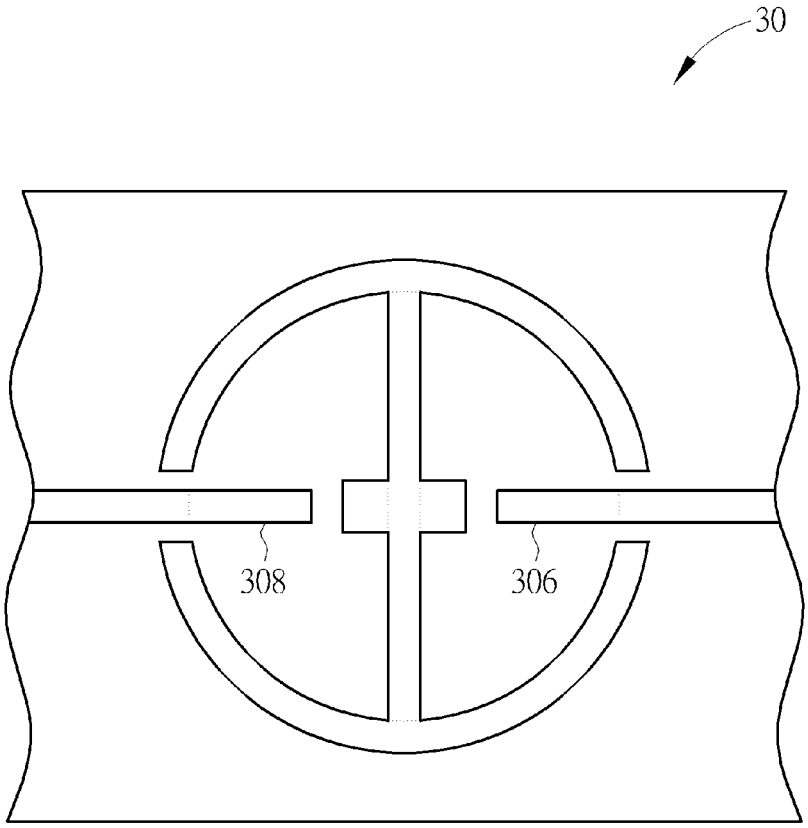
FIG. 3A is a schematic diagram illustrating a top view of a front surface of the feeding apparatus according to an embodiment of the present invention.
Figure 3B:
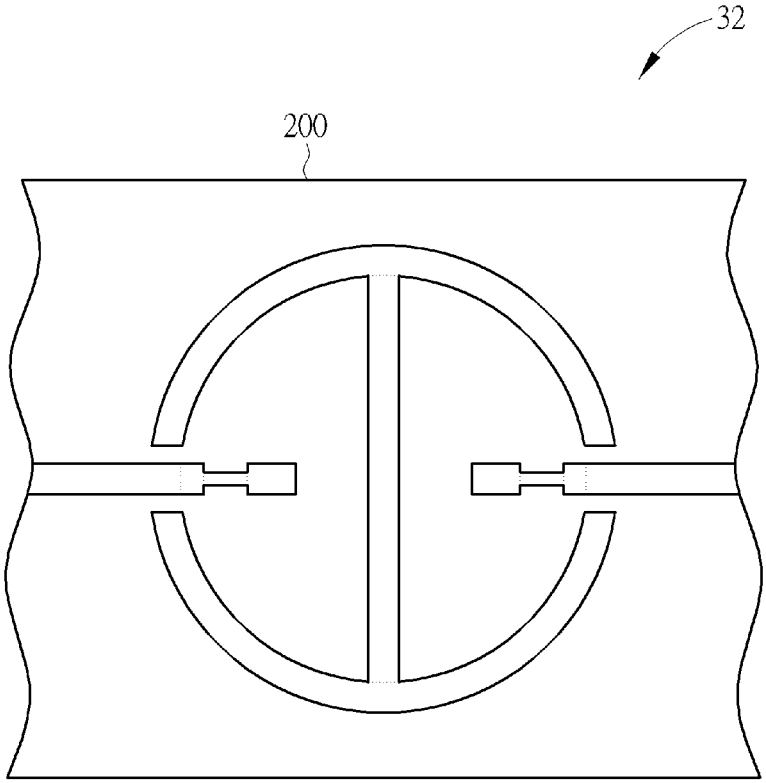
FIG. 3B is a schematic diagram illustrating a top view of a front surface of the feeding apparatus according to an embodiment of the present invention.

In order to point out the improvement on return loss at low frequencies and high frequencies by means of the parasitic grounded metal sheets 214, 216 and the feeding metal sheets 206, 208, respectively, please refer to FIG. 3A and FIG. 3B, which are schematic diagrams respectively illustrating a top view of a front surface of the feeding apparatus 30 and that of the feeding apparatus 32 according to embodiments of the present invention. Since the structure of the feeding apparatuses 30, 32 is similar to that of the feeding apparatus 20 shown in FIG. 2, the similar parts are not detailed redundantly. Unlike the feeding apparatus 20, the widths of the feeding metal sheets 306, 308 of the feeding apparatus 30 respectively keep fixed, such that the effect of the parasitic grounded metal sheets 214, 216 at low frequencies in Ku band (i.e., 10.7 GHz-11.7 GHz) is easy to tell. Moreover, the parasitic grounded metal sheets 214, 216 of the feeding apparatus 20 are removed in the feeding apparatus 32, and thus the effect of the feeding metal sheets 206, 208 at high frequencies in Ku band (i.e., 11.7 GHz-12.75 GHz) is distinguishable.

Figure 4A:
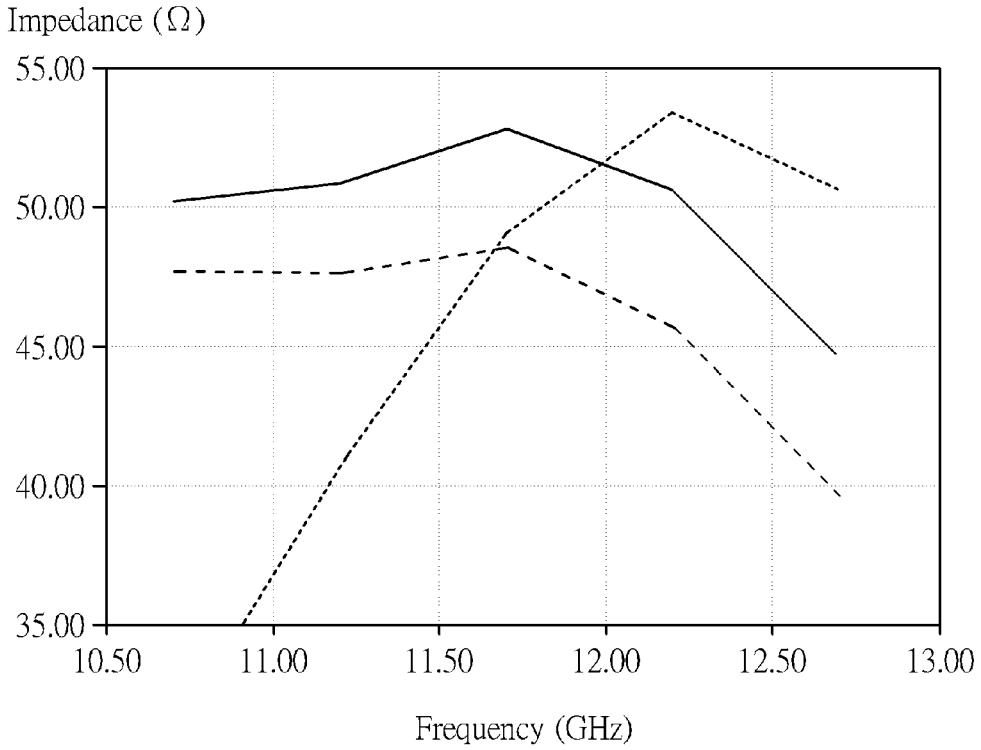
FIG. 4A is a schematic diagram illustrating how impedance of feeding apparatuses varies with frequencies.
Figure 4B:
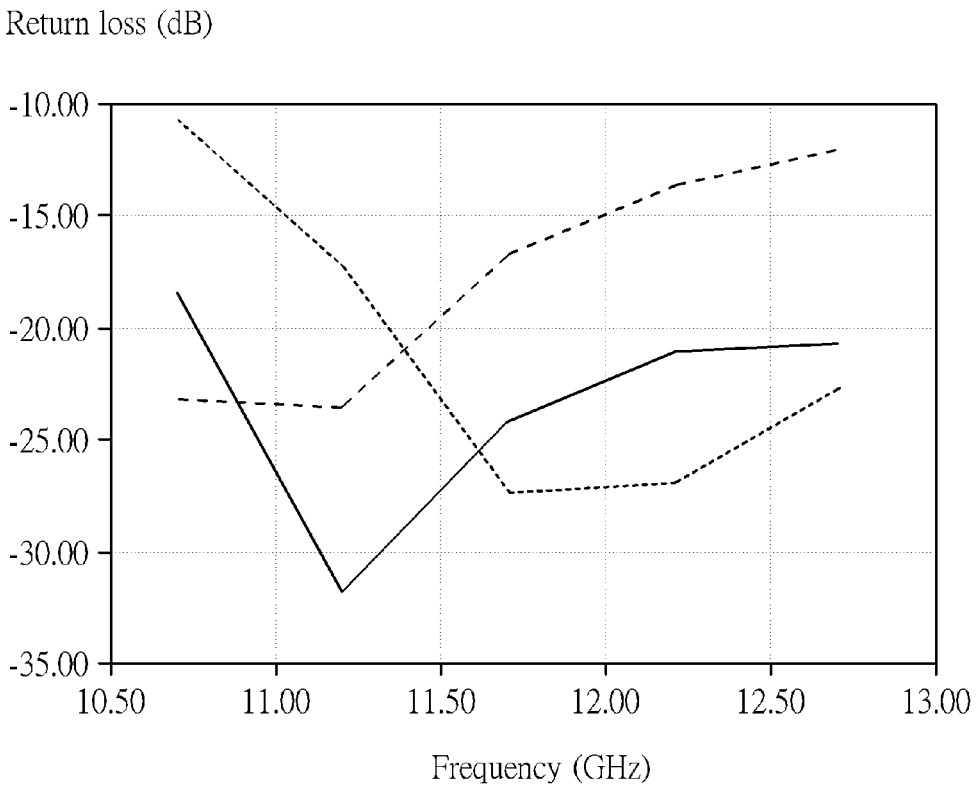
FIG. 4B is a schematic diagram illustrating return loss of feeding apparatuses.
Figure 4C:
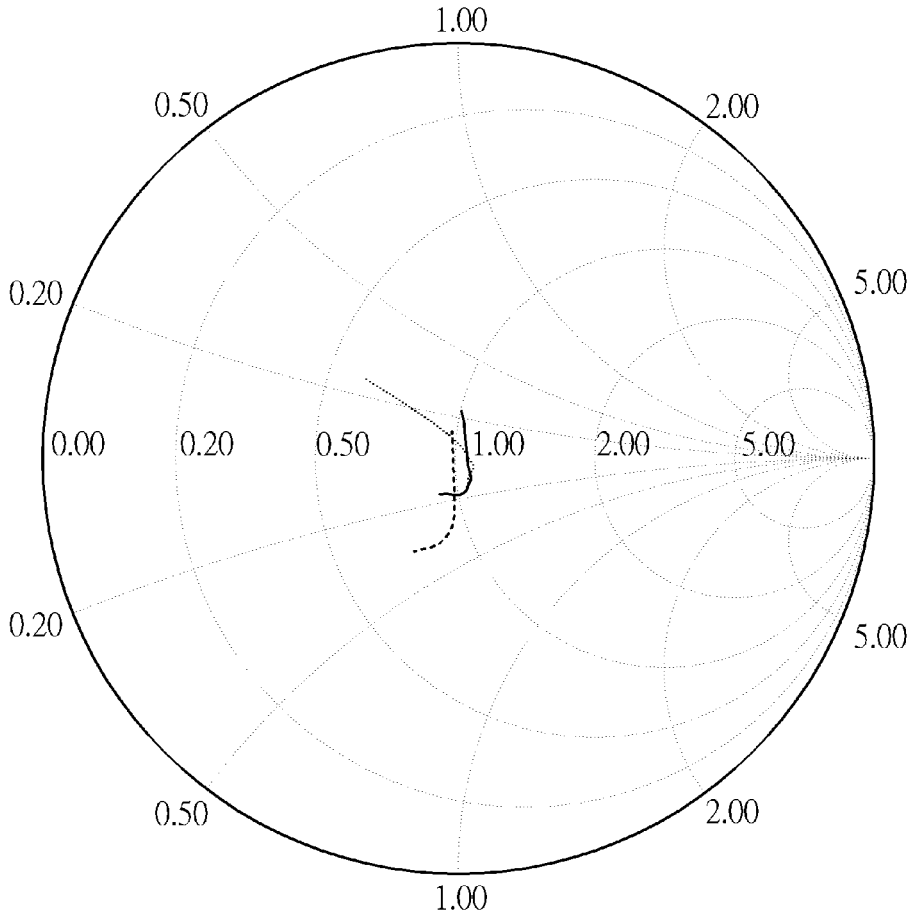
FIG. 4C is a schematic diagram illustrating feeding apparatuses in a Smith chart.

Please refer to FIGS. 4A, 4B, 4C. FIG. 4A is a schematic diagram illustrating how impedance of the feeding apparatuses 20, 30, 32 varies with frequencies. FIG. 4B is a schematic diagram illustrating return loss of the feeding apparatuses 20, 30, 32. FIG. 4C is a schematic diagram illustrating the feeding apparatuses 20, 30, 32 in a Smith chart. In FIGS. 4A, 4B, 4C, the long dashed line indicates the feeding apparatus 30, the short dashed line indicates the feeding apparatus 32, and the solid line indicates the feeding apparatus 20. As shown in FIG. 4A, with the parasitic grounded metal sheets 214, 216, the feeding apparatus 30 achieves an impedance match at low frequencies in Ku band (i.e., 10.7 GHz-11.7 GHz), meaning that the impedance is around 50 ohms (Ω). With the feeding metal sheets 206, 208, the feeding apparatus 32 achieves an impedance match at high frequencies in Ku band (i.e., 11.7 GHz-12.75 GHz), meaning that the impedance is around 50 ohms (Ω). As a result, by integrating the parasitic grounded metal sheets 214, 216 into the feeding metal sheets 206, 208, the feeding apparatus 20 can achieve impedance matching from 10.7 GHz to 12.75 GHz, thereby boosting transmission efficiency.

As shown in FIG. 4B, the return loss of the feeding apparatus 30 at low frequencies (10.7 GHz-11.7 GHz) is lower, while the return loss of the feeding apparatus 32 at high frequencies (11.7 GHz-12.75 GHz) is lower. Accordingly, the feeding apparatus 20, which combines with the parasitic grounded metal sheets 214, 216 and the feeding metal sheets 206, 208, has lower return loss from 10.7 GHz to 12.75 GHz. Therefore, the return loss at high frequencies and low frequencies in Ku band can all meet requirements, which benefits signal transmission. In addition, as shown in FIG. 4C, the feeding apparatus 30 at high frequencies is distributed further from the center of the Smith chart, while the feeding apparatus 32 at low frequencies is distributed further from the center of the Smith chart. In comparison, the feeding apparatus 20 is distributed closer to the center of the Smith chart within Ku band (10.7 GHz-12.75 GHz), and reflection coefficient is therefore smaller.

As shown in FIGS. 4A to 4C, with the parasitic grounded metal sheets 214, 216 and the feeding metal sheets 206, 208, the impedance of the feeding apparatus 20 matches the characteristic impedance of transmission lines, such that a good impedance match is simultaneously achieved at high frequencies and low frequencies, and reflection coefficient is reduced to increase transmission efficiency.

Figure 5A:
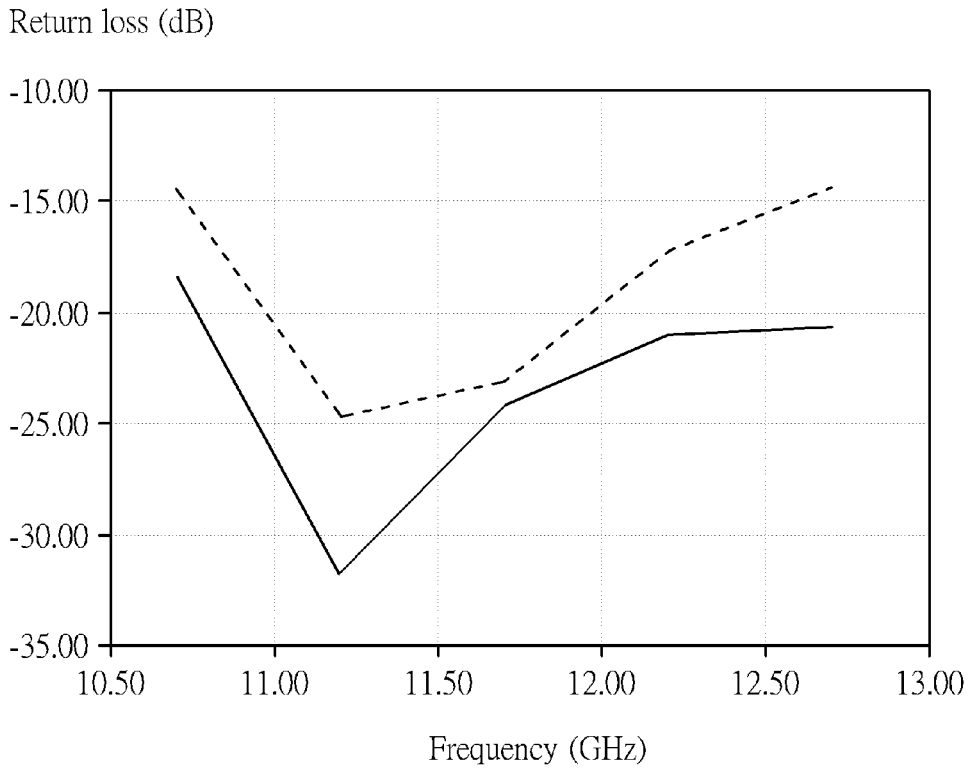
FIG. 5A is a schematic diagram illustrating return loss of feeding apparatuses.
Figure 5B:
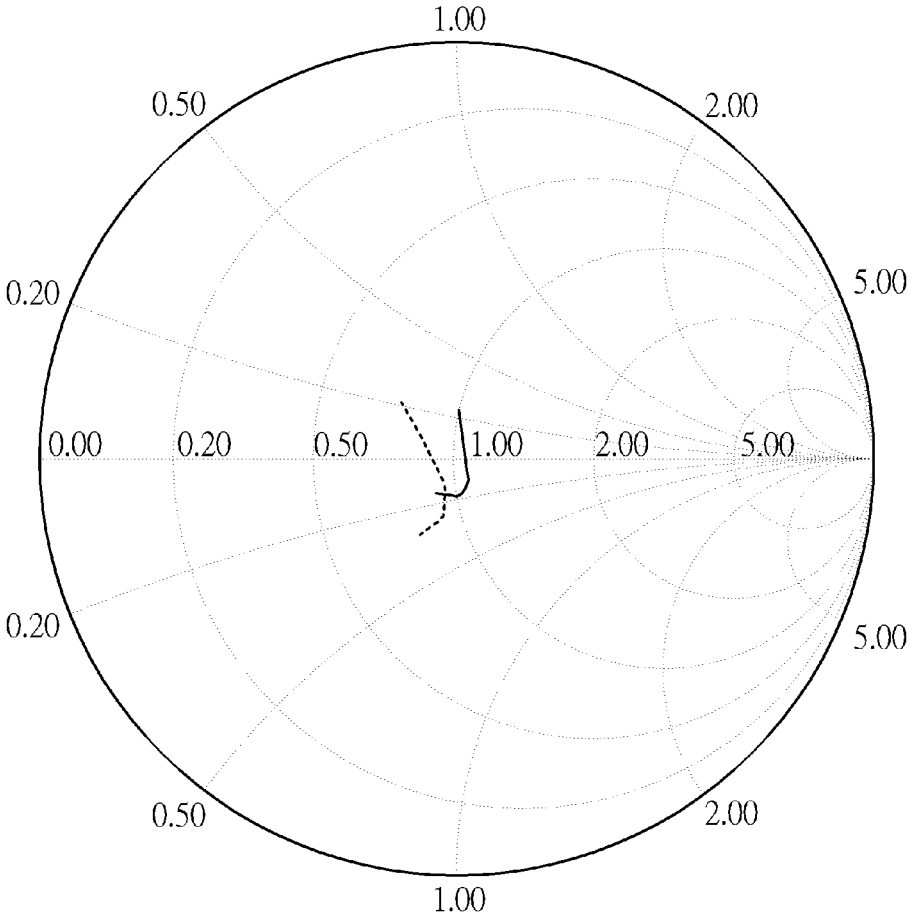
FIG. 5B is a schematic diagram illustrating feeding apparatuses in a Smith chart.

Please refer to FIGS. 5A and 5B. FIG. 5A is a schematic diagram illustrating return loss of the feeding apparatuses 100 and 20. FIG. 5B is a schematic diagram illustrating the feeding apparatuses 100 and 20 in a Smith chart. In FIGS. 5A and 5B, the dashed line indicates the feeding apparatus 100, and the solid line indicates the feeding apparatus 20. As shown in FIG. 5A, the return loss of the feeding apparatus 100 within Ku band (10.7 GHz-12.75 GHz) is higher than that of the feeding apparatus 20, such that transmission efficiency of the feeding apparatus 100 is worse than that of the feeding apparatus 20 of the present invention. Besides, as shown in FIG. 5B, the feeding apparatus 20 is distributed closer to the center of the Smith chart within Ku band (10.7 GHz-12.75 GHz) than the feeding apparatus 100 is; thus, the reflection coefficient of the feeding apparatus 20 is smaller than that of the feeding apparatus 100, and the impedance of the feeding apparatus 20 matches the characteristic impedance of transmission lines more. In other words, comparing to the feeding apparatus 100, the feeding apparatus 20 achieves impedance matching at high frequencies and low frequencies. As set forth above, by modifying the widths of the feeding metal sheets 206, 208, disposing the parasitic grounded metal sheets 214, 216, and properly adjusting the distance between the parasitic grounded metal sheet 214 and the feeding metal sheet 206 and between the parasitic grounded metal sheet 216 and the feeding metal sheet 208, impedance matching at high frequencies and low frequencies can be effectively improved and return loss is also reduced.

Please note that the feeding apparatus 20 is an exemplary embodiment of the invention, and those skilled in the art can make alternations and modifications accordingly. For example, any kind or material of substrate on which layout can be drawn can be served as the substrate 200. Preferably, the lengths of the feeding metal sheets 206, 208 are substantially one quarter of the wavelength of received signals, but appropriate adjustments are also feasible. The back-end radio frequency processing unit coupled to the signal wires 210, 212 may be a low noise amplifier, an intermediate frequency (IF) filter, an IF amplifier, other radio frequency circuits, or any combination thereof, but not limited thereto. Besides, the feedhorn 12, the waveguide 14 and the septum polarizer 16 of the low noise block down-converter 10 here aim to illustrate the feeding apparatus 20, and hence those skilled in the art might appropriately modify them according to different design considerations and system requirements. For example, the feedhorn 12 can be applied into different shapes of the opening, such as a square, circle, rectangle, rhombus and ellipse. Moreover, the feedhorn 12 may have corrugations inside to improve a radiation pattern of the feedhorn, such that the radiation pattern may be more symmetric and centralized to decrease a spillover loss of the feedhorn.

On the other hand, in the feeding apparatus 20, extending centerlines 220, 222 of the feeding metal sheets 206, 208 are respectively perpendicular to the rectangular grounded metal sheet 204; however, in other embodiments, there may be an included angle between the extending centerline of a feeding metal sheet and the rectangular grounded metal sheet 204. Specifically, please refer to FIG. 6, which is a schematic diagram illustrating a top view of a front surface of a feeding apparatus 60 according to an embodiment of the present invention. The feeding apparatus 60 comprises a substrate 600, an annular grounded metal sheet 602, a rectangular grounded metal sheet 604, feeding metal sheets 606, 608, signal wires 610, 612 and parasitic grounded metal sheets 614, 616. Comparing the feeding apparatus 20 shown in FIG. 2 and the feeding apparatus 60 shown in FIG. 6, although the structure of the feeding apparatus 60 is similar to that of the feeding apparatus 20 shown in FIG. 2, openings of the annular grounded metal sheet 602 locate differently from the openings of the annular grounded metal sheet 202. The annular grounded metal sheet 602 is also in a shape of an annularity substantially with two openings that break an enclosed circle, and therefore the annular grounded metal sheet 602 is divided into two separate portions 6020, 6022 of different sizes. The two openings are respectively at angles $\theta_1$ and $\theta_2$ with respect to the vertical. The feeding metal sheets 606, 608 extend from the two openings of the annular grounded metal sheet 602 toward the interior of the annularity. That is to say, there is an included angle $\theta_1$ between the extension of the rectangular grounded metal sheet 604 and the extending centerline of the feeding metal sheet 606, and there is an included angle $\theta_2$ between the extension of the rectangular grounded metal sheet 604 and the extending centerline of the feeding metal sheet 608. Additionally, the feeding apparatus 60 may be operated in a way similar to the feeding apparatus 20 shown in FIG. 2; therefore, related details can be found from the aforementioned illustrations.

Figure 6:
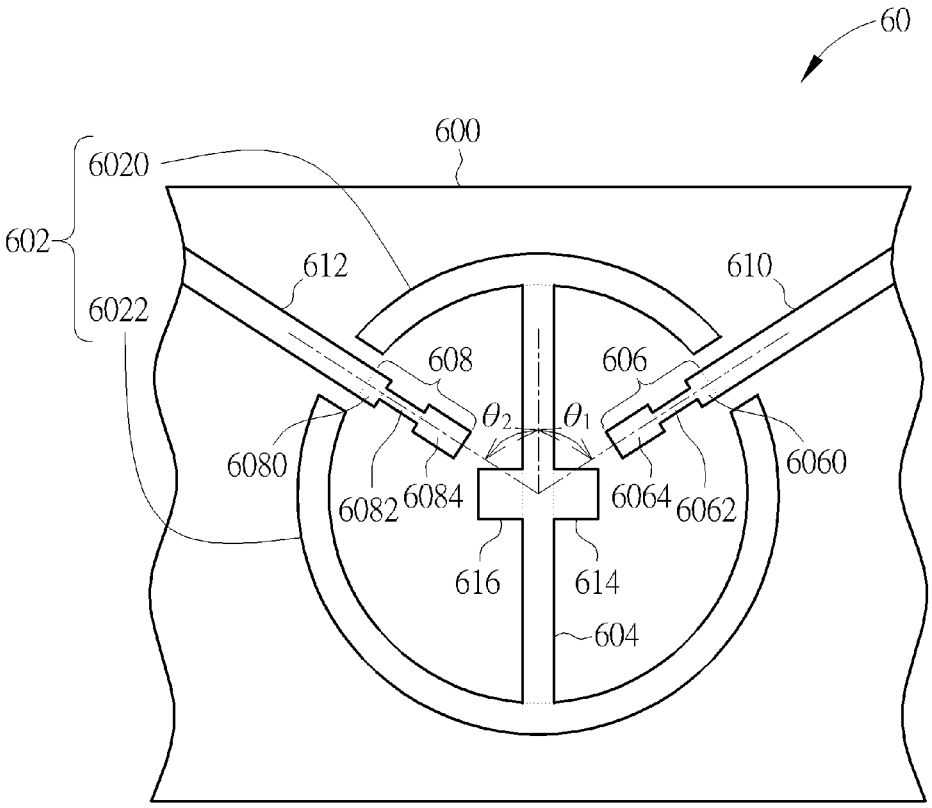
FIG. 6 is a schematic diagram illustrating a top view of a front surface of a feeding apparatus according to an embodiment of the present invention.

In FIG. 6, the included angles $\theta_1$, $\theta_2$ may be in a range of 0° (degrees) to 90°, but not limited thereto. Since the effective length of the substrate 600 in the horizontal direction (i.e., the direction perpendicular to the rectangular grounded metal sheet 604) depends on the orientation of the feeding metal sheets 606, 608, the effective length of the substrate 600 in the horizontal direction can effectively shrink by minimizing the included angles $\theta_1$, $\theta_2$. As a result, density of the back-end radio frequency processing unit increases, circuit layout area of the substrate 200 is saved, and fewer screws are required, thereby reducing product volume, product weight, and manufacturing cost.

Figure 7A:
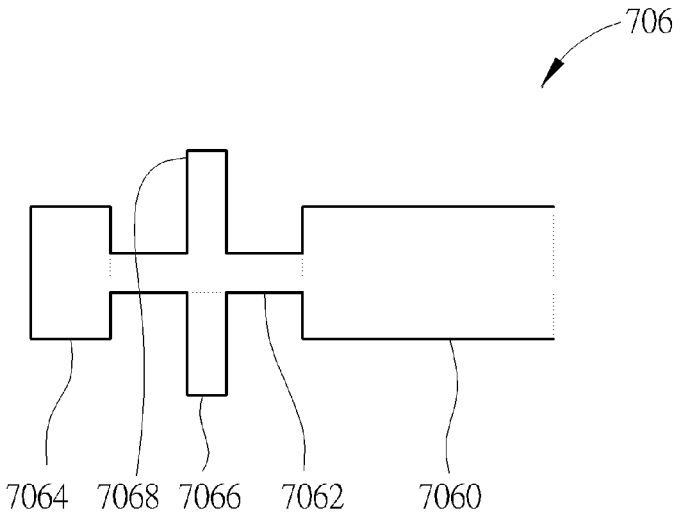
FIG. 7A is a schematic diagram illustrating a feeding metal sheet according to an embodiment of the present invention.
Figure 7B:
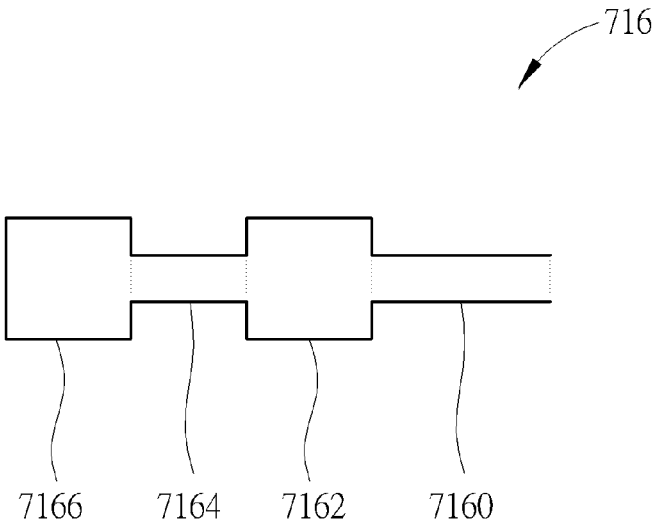
FIG. 7B is a schematic diagram illustrating a feeding metal sheet according to an embodiment of the present invention.
Figure 7C:
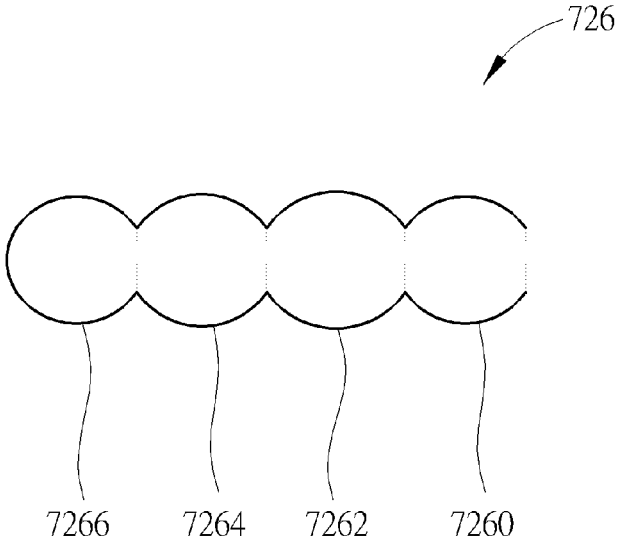
FIG. 7C is a schematic diagram illustrating a feeding metal sheet according to an embodiment of the present invention.

Apart from location of the feeding metal sheets and location of the openings of the annular grounded metal sheet, branches may be added in each portion, and the shape of the feeding metal sheet may be modified. Please refer to FIGS. 7A to 7C, which are schematic diagrams respectively illustrating feeding metal sheets 706, 716, 726 according to embodiments of the present invention. The feeding metal sheets 706, 716, 726 can replace the feeding metal sheets 206, 208 shown in FIG. 2 (or the feeding metal sheets 606, 608 shown in FIG. 6). As shown in FIG. 7A, the feeding metal sheet 706 comprises portions 7060, 7062, 7064 and branches 7066, 7068. When the feeding metal sheet 706 is utilized to replace the feeding metal sheets in previous embodiments, the portion 7060 is electrically connected to a signal wire (e.g., one of the signal wires 210, 212, 610, 612), the portion 7062 and the portion 7064 extend toward the interior of the annularity of the annular grounded metal sheet in sequence, and the branches 7066 and 7068 extends oppositely from two sides of the portion 7062. As shown in FIG. 7B, the feeding metal sheet 716 comprises portions 7160, 7162, 7164, 7166. The portion 7160 is electrically connected to a signal wire, and the portions 7162, 7164 and 7166 extend toward the interior of the annular of the annular grounded metal sheet in sequence. As shown in FIG. 7C, the feeding metal sheet 726 comprises portions 7260, 7262, 7264, 7266. The portion 7260 is electrically connected to a signal wire, the portions 7262, 7264, 7266 extend toward the interior of the annularity of the annular grounded metal sheet in sequence, and the portion 7260, 7262, 7264, 7266 are in the shape of a curve.

In FIG. 7A, the branches 7066, 7068 are disposed on the sides of the portion 7062, but in other embodiments, branches may be designed on the sides of the portion 7060 or the portion 7064, and the number of branches may be modified according different considerations. In FIG. 7B, the feeding metal sheet 716 is divided into four portions. The widths of the portion 7162 and the portion 7166 are greater than that of the portion 7160 and that of the portion 7164, but not limited thereto. In other words, the widths of the portions can vary without following a specific rule and may not increase gradually. Moreover, the number of portions of the feeding metal sheet 716 is not limited to a specific value, but may be several portions. Consequently, with the number, relative width and shape of the portions properly adjusted and branches disposed, the impedance of the feeding apparatus can be changed as one would wish.

Figure 8:
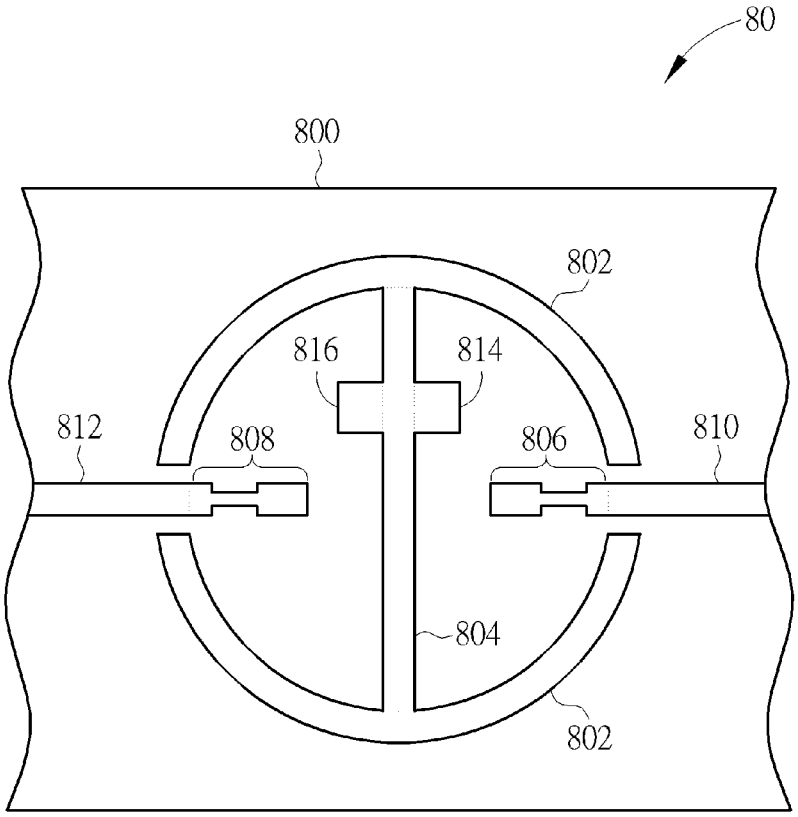
FIG. 8 is a schematic diagram illustrating a top view of a front surface of a feeding apparatus according to an embodiment of the present invention.

Apart from adjusting the structure of feeding metal sheets, location of parasitic grounded metal sheets with respect to the rectangular grounded metal sheet may be appropriately modified to meet the desired impedance. Please refer to FIG. 8, which is a schematic diagram illustrating a top view of a front surface of a feeding apparatus 80 according to an embodiment of the present invention. The feeding apparatus 80 comprises a substrate 800, an annular grounded metal sheet 802, a rectangular grounded metal sheet 804, feeding metal sheets 806, 808, signal wires 810, 812 and parasitic grounded metal sheets 814, 816. Comparing the feeding apparatus 80 to the feeding apparatus 20 shown in FIG. 2, although the structure of the feeding apparatus 80 is similar to that of the feeding apparatus 20 shown in FIG. 2, the parasitic grounded metal sheets 814, 816, with respect to the rectangular grounded metal sheet 804, locate differently from the feeding apparatus 20. As shown in FIG. 8, the parasitic grounded metal sheets 814, 816 on opposite sides of the rectangular grounded metal sheet 804 may be disposed along the rectangular grounded metal sheet 804 but at different locations, and hence the cross shape formed by the rectangular grounded metal sheet 804 and the parasitic grounded metal sheets 814, 816 varies. Additionally, the feeding apparatus 80 may be operated in a way similar to the feeding apparatus 20 shown in FIG. 2; therefore, related details can be found from the aforementioned illustrations.

Figure 9A:
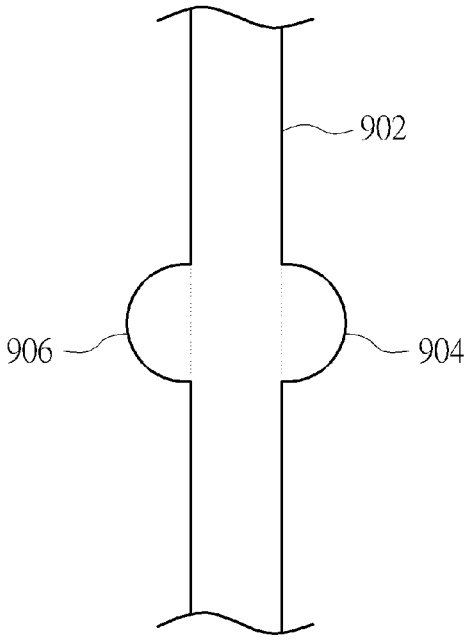
FIG. 9A is a schematic diagram illustrating a locally enlarged view of a rectangular grounded metal sheet and parasitic grounded metal sheets according to an embodiment of the present invention.
Figure 9B:
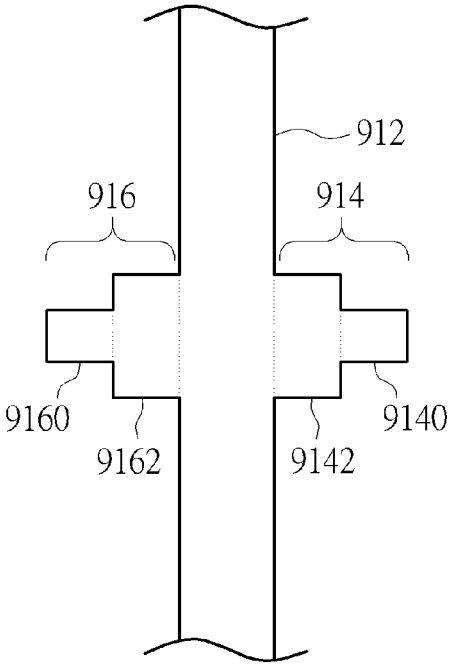
FIG. 9B is a schematic diagram illustrating a locally enlarged view of a rectangular grounded metal sheet and parasitic grounded metal sheets according to an embodiment of the present invention.
Figure 9C:
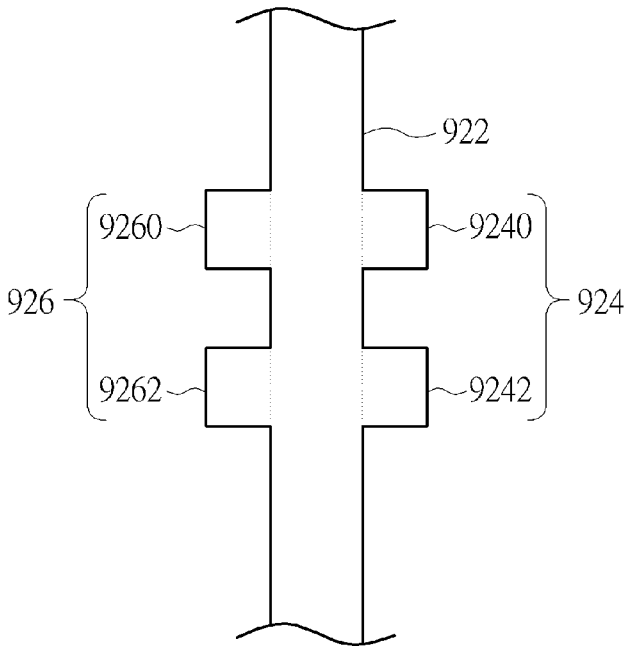
FIG. 9C is a schematic diagram illustrating a locally enlarged view of a rectangular grounded metal sheet and parasitic grounded metal sheets according to an embodiment of the present invention.

The shape of the parasitic grounded metal sheets may be adjusted as the number of the portions increases. Please refer to FIGS. 9A to 9C. FIG. 9A is a schematic diagram illustrating a locally enlarged view of a rectangular grounded metal sheet 902 and parasitic grounded metal sheets 904, 906 according to an embodiment of the present invention. FIG. 9B is a schematic diagram illustrating a locally enlarged view of a rectangular grounded metal sheet 912 and parasitic grounded metal sheets 914, 916 according to an embodiment of the present invention. FIG. 9C is a schematic diagram illustrating a locally enlarged view of a rectangular grounded metal sheet 922 and parasitic grounded metal sheets 924, 926 according to an embodiment of the present invention. The rectangular grounded metal sheets 902, 912, 922 and the associated parasitic grounded metal sheets 904, 906, 914, 916, 924, 926 can replace the rectangular grounded metal sheet 204 and the parasitic grounded metal sheets 214, 216 shown in FIG. 2 (or other embodiments). As shown in FIG. 9A, the parasitic grounded metal sheets 904, 906 respectively extend from two opposite sides of the rectangular grounded metal sheet 902, and the parasitic grounded metal sheets 904, 906 are in the shape of a curve. As shown in FIG. 9B, the parasitic grounded metal sheets 914, 916 respectively extend from two opposite sides of the rectangular grounded metal sheet 912. The parasitic grounded metal sheet 914 comprises portions 9140, 9142 of different widths; the parasitic grounded metal sheet 916 comprises portions 9160, 916 of different widths. The variation of the widths may be further modified according to different system requirements. As shown in FIG. 9C, the parasitic grounded metal sheet 924, 926 respectively extend from two opposite sides of the rectangular grounded metal sheet 922. The parasitic grounded metal sheet 924 comprises portions 9240, 9242; the parasitic grounded metal sheet 926 comprises portions 9260, 9262. The variation of the widths of the portions 9240, 9242 and the portions 9260, 9262 may also be modified according to different system requirements. It is worth noting that the number of portions of the parasitic grounded metal sheets 914, 916, 924, 926 shown in FIGS. 9B and 9C is not limited to a specific value, but may be several portions. Moreover, the widths of the portions can vary without following a specific rule and may not increase gradually. Consequently, as the number, relative width and shape of the portions are properly adjusted, the impedance of the feeding apparatus can be changed as one would wish.

To sum up, by modifying widths of feeding metal sheets, disposing parasitic grounded metal sheets, and properly adjusting the distance between the parasitic grounded metal sheet and the feeding metal sheet, impedance of the feeding apparatus in operating frequency range match more toward both the low frequency end and the high frequency end, thereby improving return loss at high frequencies and low frequencies. In other words, a good impedance matching is achieved and return loss is reduced with the designed pattern of the feeding apparatus, and design freedom diverges while it is still easy to manufacture.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A feeding apparatus, adapted to a waveguide, the feeding apparatus comprising:

a substrate;

an annular grounded metal sheet, disposed on the substrate, substantially in a shape of an annularity, and having a first opening and a second opening;

a rectangular grounded metal sheet, disposed on the substrate, extending from the annular grounded metal sheet across an interior of the annularity and corresponding to a configuration of a polarizer of the waveguide;

a first parasitic grounded metal sheet, extending from a side of the rectangular grounded metal sheet along a first direction;

a second parasitic grounded metal sheet, extending from another side of the rectangular grounded metal sheet along a second direction, wherein the second direction is substantially opposite to the first direction;

a first feeding metal sheet, extending from the first opening toward the interior of the annularity and comprising a first portion, a second portion and a third portion, wherein a width of the first portion is different from a width of the second portion, and the width of the second portion is different from a width of the third portion; and a second feeding metal sheet, extending from the second opening toward the interior of the annularity and comprising a fourth portion, a fifth portion and a sixth portion, wherein a width of the fourth portion is different from a width of the fifth portion, and the width of the fifth portion is different from a width of the sixth portion.

2. The feeding apparatus of claim 1, wherein the width of the second portion is smaller than the width of the first portion and the width of the third portion.

3. The feeding apparatus of claim 1, wherein the width of the fifth portion is smaller than the width of the fourth portion and the width of the sixth portion.

4. The feeding apparatus of claim 1, wherein the first parasitic grounded metal sheet and the second parasitic grounded metal sheet are symmetrical.

5. The feeding apparatus of claim 1, wherein the first feeding metal sheet and the second feeding metal sheet are symmetrical.

6. The feeding apparatus of claim 1, wherein a centerline of the first parasitic grounded metal sheet extends to a center of the rectangular grounded metal sheet, and a centerline of the second parasitic grounded metal sheet extends to the center of the rectangular grounded metal sheet.

7. The feeding apparatus of claim 1, wherein a first included angle exists between an extension of the first feeding metal sheet and an extension of the rectangular grounded metal sheet, and a second included angle exists between an extension of the second feeding metal sheet and the extension of the rectangular grounded metal sheet.

8. The feeding apparatus of claim 7, wherein the first included angle or the second included angle is substantially equal to 90 degrees.

9. The feeding apparatus of claim 1, further comprising a first signal wire and a second signal wire, wherein the first signal wire is electrically connected to the first portion of the first feeding metal sheet, and the second signal wire is electrically connected to the fourth portion of the second feeding metal sheet.

10. The feeding apparatus of claim 1, wherein a length of the first feeding metal sheet or a length of the second feeding metal sheet is equal to a quarter of a wavelength of a received signal.

11. A low noise block down-converter, adapted to a communication receiving device, the low noise block down-converter comprising:

a feedhorn;

a waveguide;

a polarizer; and a feeding apparatus, comprising:

a substrate;

an annular grounded metal sheet, disposed on the substrate, substantially in a shape of an annularity, and having a first opening and a second opening;

a rectangular grounded metal sheet, disposed on the substrate, extending from the annular grounded metal sheet across an interior of the annularity and corresponding to a configuration of a polarizer of the waveguide;

a first parasitic grounded metal sheet, extending from a side of the rectangular grounded metal sheet along a first direction;

a second parasitic grounded metal sheet, extending from another side of the rectangular grounded metal sheet along a second direction, wherein the second direction is substantially opposite to the first direction;

a first feeding metal sheet, extending from the first opening toward the interior of the annularity and comprising a first portion, a second portion and a third portion, wherein a width of the first portion is different from a width of the second portion, and the width of the second portion is different from a width of the third portion; and a second feeding metal sheet, extending from the second opening toward the interior of the annularity and comprising a fourth portion, a fifth portion and a sixth portion, wherein a width of the fourth portion is different from a width of the fifth portion, and the width of the fifth portion is different from a width of the sixth portion.

12. The low noise block down-converter of claim 11, wherein the width of the second portion is smaller than the width of the first portion and the width of the third portion.

13. The low noise block down-converter of claim 11, wherein the width of the fifth portion is smaller than the width of the fourth portion and the width of the sixth portion.

14. The low noise block down-converter of claim 11, wherein the first parasitic grounded metal sheet and the second parasitic grounded metal sheet are symmetrical.

15. The low noise block down-converter of claim 11, wherein the first feeding metal sheet and the second feeding metal sheet are symmetrical.

16. The low noise block down-converter of claim 11, wherein a centerline of the first parasitic grounded metal sheet extends to a center of the rectangular grounded metal sheet, and a centerline of the second parasitic grounded metal sheet extends to the center of the rectangular grounded metal sheet.

17. The low noise block down-converter of claim 11, wherein a first included angle exists between an extension of the first feeding metal sheet and an extension of the rectangular grounded metal sheet, and a second included angle exists between an extension of the second feeding metal sheet and the extension of the rectangular grounded metal sheet.

18. The low noise block down-converter of claim 17, wherein the first included angle or the second included angle is substantially equal to 90 degrees.

19. The low noise block down-converter of claim 11, further comprising a first signal wire and a second signal wire, wherein the first signal wire is electrically connected to the first portion of the first feeding metal sheet, and the second signal wire is electrically connected to the fourth portion of the second feeding metal sheet.

20. The low noise block down-converter of claim 11, wherein a length of the first feeding metal sheet or a length of the second feeding metal sheet is equal to a quarter of a wavelength of a received signal.

* * * * *